US011266564B1

(12) United States Patent
Broms

(10) Patent No.: US 11,266,564 B1
(45) Date of Patent: Mar. 8, 2022

(54) SUCTION-BASED ATTACHMENT SYSTEM FOR SEXUAL STIMULATION

(71) Applicant: Diamond Products, LLC, West Hills, CA (US)

(72) Inventor: Kristian Broms, West Hills, CA (US)

(73) Assignee: PD Products, LLC, West Hills, CA (US)

( * ) Notice: Subject to any disclaimer, the term of this patent is extended or adjusted under 35 U.S.C. 154(b) by 0 days.

(21) Appl. No.: 17/326,200

(22) Filed: May 20, 2021

(51) Int. Cl.
*A61H 19/00* (2006.01)

(52) U.S. Cl.
CPC ..... *A61H 19/44* (2013.01); *A61H 19/50* (2013.01); *A61H 2201/013* (2013.01); *A61H 2201/163* (2013.01); *A61H 2201/1652* (2013.01)

(58) Field of Classification Search
CPC ..... A61H 19/00; A61H 19/30; A61H 19/40; A61H 19/44; A61H 19/50
See application file for complete search history.

(56) References Cited

U.S. PATENT DOCUMENTS

| | | | | |
|---|---|---|---|---|
| 5,127,396 | A | 7/1992 | McAllister | |
| 6,547,717 | B1 * | 4/2003 | Green | A61F 5/41 600/38 |
| 8,398,539 | B2 * | 3/2013 | Stevens | A61H 19/44 600/38 |
| 2004/0129274 | A1 * | 7/2004 | Espinosa | F16M 11/10 128/845 |
| 2005/0273024 | A1 * | 12/2005 | Nan | A61H 19/44 601/71 |
| 2017/0239134 | A1 * | 8/2017 | Rossi | A61H 19/44 |
| 2019/0060161 | A1 * | 2/2019 | Moreno | A61H 19/50 |

* cited by examiner

*Primary Examiner* — John P Lacyk
(74) *Attorney, Agent, or Firm* — Akerman LLP

(57) ABSTRACT

According to one example, a suction-based attachment system includes a body plate configured to be positioned against a pelvis of a person, and a suction docking protrusion coupled to the body plate. The body plate has a back surface configured to face the pelvis of the person, and a front surface configured to face away from the pelvis of the person. The suction docking protrusion includes a suction docking surface that is configured to operate as an attachment area for a suction cup included on a prosthetic phallic device, via an air vacuum formed in-between the suction docking surface and the suction cup included on the prosthetic phallic device.

14 Claims, 3 Drawing Sheets

SUCTION-BASED ATTACHMENT SYSTEM FOR SEXUAL STIMULATION

TECHNICAL FIELD

This disclosure relates generally to intimate items for sexual stimulation, and more particularly to a suction-based attachment system for sexual stimulation.

BACKGROUND

The use of prosthetic phallic devices for sexual stimulation is well-known. These devices come in a variety of shapes, sizes and configurations and are constructed out of various formulations of plastic, synthetic rubber, and silicone. Furthermore, some of these devices can move or vibrate to enhance the stimulating experience of the device. Devices that include such a feature are often referred to as "vibrators" and those that do not are generally referred to as "dildos". These typical prosthetic phallic devices, however, may be deficient.

SUMMARY

According to one example, a suction-based attachment system includes a body plate configured to be positioned against a pelvis of a person, and a suction docking protrusion coupled to the body plate. The body plate has a back surface configured to face the pelvis of the person, and a front surface configured to face away from the pelvis of the person. The suction docking protrusion includes a suction docking surface that is configured to operate as an attachment area for a suction cup included on a prosthetic phallic device, via an air vacuum formed in-between the suction docking surface and the suction cup included on the prosthetic phallic device.

Certain examples in the disclosure may provide one or more technical advantages. For example, the suction-based attachment system may allow the prosthetic phallic device to be mounted to the suction docking surface using the suction cup already built-in to the prosthetic phallic device (via an air vacuum formed in-between the suction docking surface and the suction cup), and without the use of additional attachment systems (e.g., straps, an o-ring, or a peg system). Additionally, the suction-based attachment system may allow for the use of many different prosthetic phallic devices, where each device can be easily removed and replaced with a different device, in some examples.

Certain examples in the disclosure may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Examples of the present disclosure are best understood by referring to FIGS. 1A-3 of the drawings, like numerals being used for like and corresponding parts of the various drawings.

The use of prosthetic phallic devices for sexual stimulation is well-known. These devices come in a variety of shapes, sizes and configurations and are constructed out of various formulations of plastic, synthetic rubber, and silicone. Furthermore, some of these devices can move or vibrate to enhance the stimulating experience of the device. Devices that include such a feature are often referred to as "vibrators" and those that do not are generally referred to as "dildos". These typical prosthetic phallic devices, however, may be deficient.

For example, typical prosthetic phallic devices may require that the user either hold the device with his or her hand or have a partner operate the device with their hand(s). This may be insufficient if the user or partner would prefer (or has a medical need for) a hands-free experience. As another example, some prosthetic phallic devices may have a suction cup that allows the device to be mounted to the floor, wall, or a piece of furniture. This use of the prosthetic phallic device may be uncomfortable, inconvenient, or may exclude a user's partner. As a further example, some prosthetic phallic devices may be used with a harness system that holds the prosthetic phallic device in place on the harness system using straps, an o-ring, or a peg system. This, however, may require a specially made prosthetic phallic device, as opposed to widely commercially available prosthetic phallic devices. It also may make it difficult to easily remove and/or replace the prosthetic phallic device with a different prosthetic phallic device. In contrast to this, the suction-based attachment system 10 of FIGS. 1A-3 may address one or more of these disadvantages.

Figure 1A:
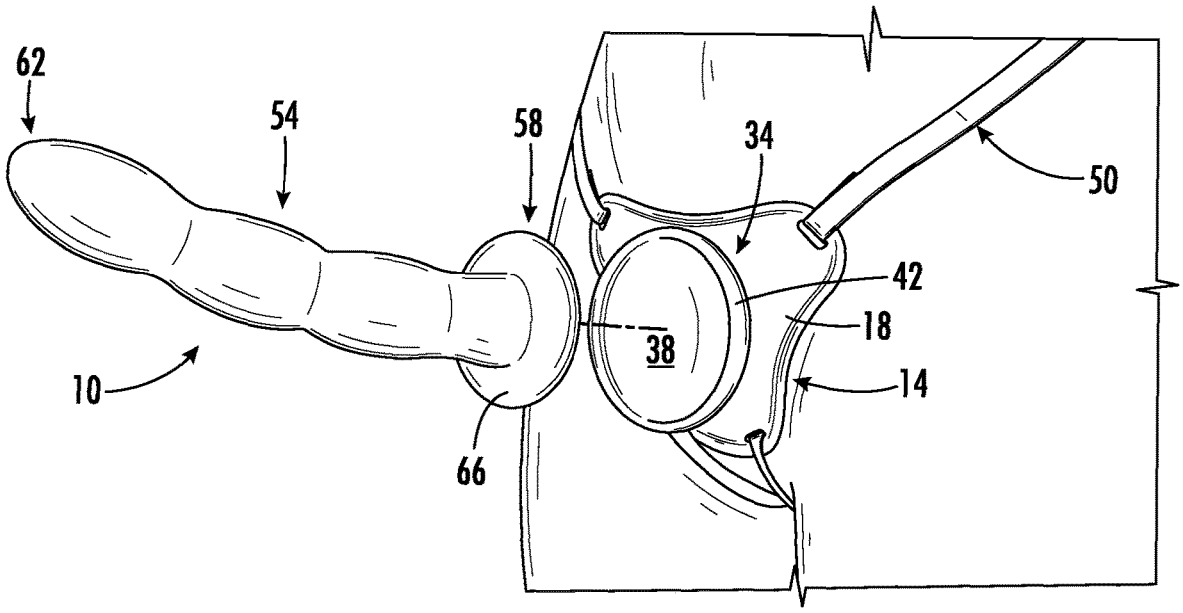
FIG. 1A illustrates one example of a suction-based attachment system, with a suction docking system coupled to a user, and with a prosthetic phallic device removed from the suction docking system.
Figure 1B:
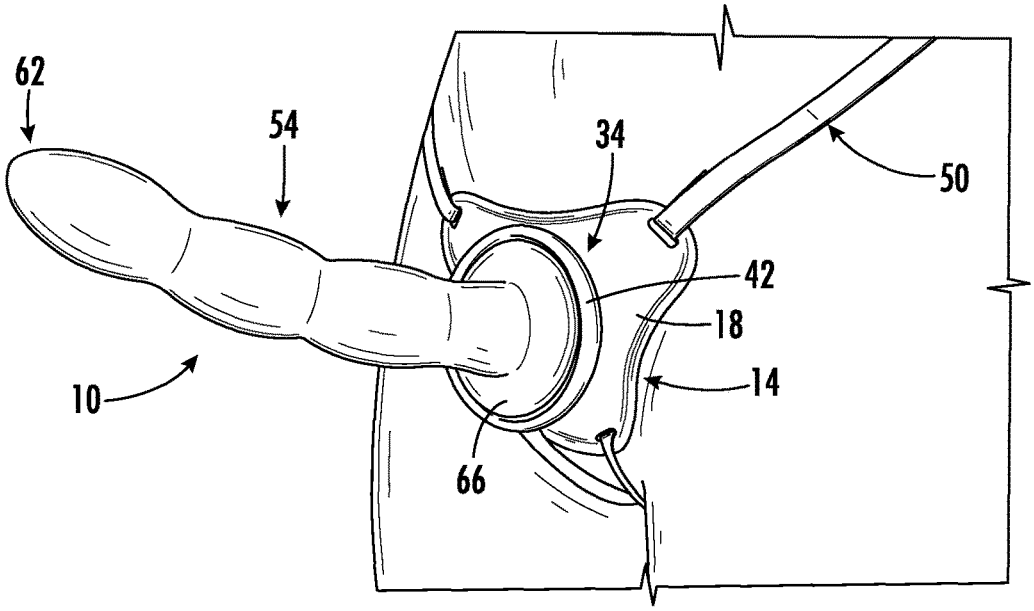
FIG. 1B illustrates the suction-based attachment system of FIG. 1A, with the prosthetic phallic device coupled to the suction docking system.

FIGS. 1A-1B illustrate one example of a suction-based attachment system 10. In the illustrated example, the suction-based attachment system 10 includes a suction docking system 14, a harness 50, and a prosthetic phallic device 54 having a suction cup 66. In an example of operation, the suction docking system 14 is worn by a user (e.g., worn against the pelvis of the user, as is seen in FIGS. 1A-1B), with the harness 50 securing the suction docking system 14 to the user. The user attaches the prosthetic phallic device 54 to the suction docking system 14 by pressing the suction cup 66 of the prosthetic phallic device 54 against a suction docking surface 38 of the suction docking system 14. The user can then use the prosthetic phallic device 54 for sexual simulation. Furthermore, the user can remove the prosthetic phallic device 54 from the suction docking system 14 and replace it with a different prosthetic phallic device 54.

The suction-based attachment system 10 may allow a user to utilize a prosthetic phallic device without requiring the user to hold the prosthetic phallic device in one or more of their hands (e.g., it may be hands-free), in some examples. It may also allow the prosthetic phallic device to be enjoyed by the user and their partner, in some examples. Also, it may further allow the prosthetic phallic device to be mounted to the suction docking system 14 using the suction cup already built-in to the prosthetic phallic device, and without the use of additional attachment systems (e.g., straps, an o-ring, or a peg system), in some examples. Furthermore, it may allow for an easy removal of the prosthetic phallic device. For example, because the suction-based attachment system 10 does not require additional connectors (e.g., straps, an o-ring, or a peg system) to hold the prosthetic phallic device in place, removing the prosthetic phallic device is as simple as sliding one finger between the suction docking surface 38 and the bottom of the suction cup 66 to allow air to flow in-between the suction docking surface 38 and the suction cup 66 to release the connection between them, in some examples. Additionally, it may allow for the use of many different prosthetic phallic devices, where each device can be easily removed and replaced with a different device, in some examples.

Figure 2D:
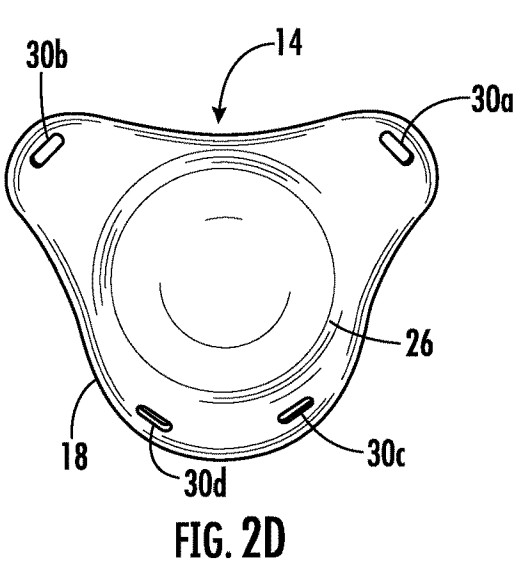
FIGS. 2A-2D are various views of the suction docking system of FIG. 1A.
Figure 2C:
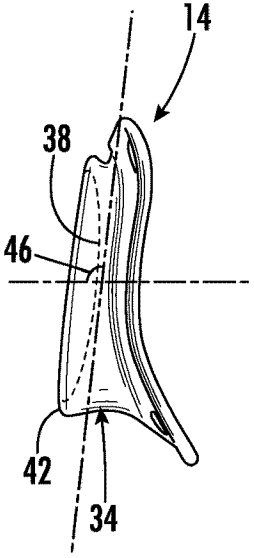
Figure 2B:
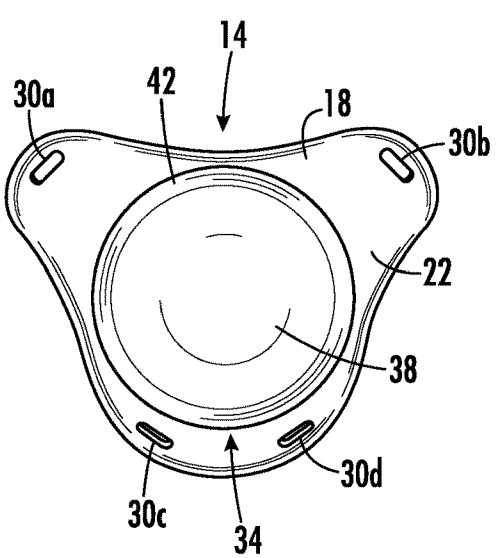
Figure 2A:
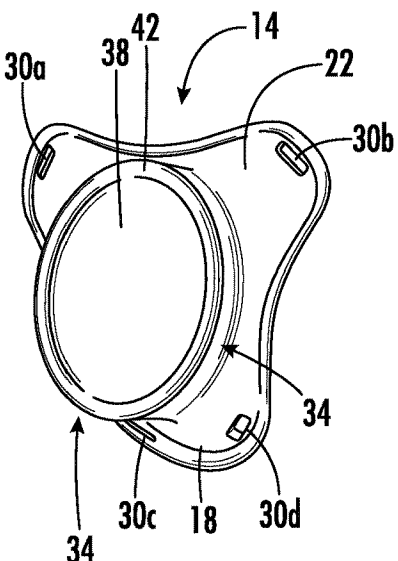

In the example illustrated in FIGS. 1A-1B, the suction-based attachment system 10 includes a suction docking system 14. Various views of this suction docking system 14 are illustrated in FIGS. 2A-2D. FIG. 2A is a perspective view of the suction docking system 14, FIG. 2B is a front view of the suction docking system 14, FIG. 2C is a side view of the suction docking system 14, and FIG. 2D is a back view of the suction docking system 14.

In the illustrated example, the suction docking system 14 includes a body plate 18 and a suction docking protrusion 34. The body plate 18 may be any structure that can be positioned against a pelvis of a user (e.g., a person). In the illustrated example, the body plate 18 includes a front surface 22 and a back surface 26. When the body plate 18 is positioned against the pelvis of the user (as is illustrated in FIGS. 1A-1B), the front surface 22 faces away from the pelvis of the user, and the back surface 26 faces towards the pelvis of the user. To assist in being positioned against the pelvis of the user, the back surface 26 may be concave (as opposed to being flat or convex). This concave shape of the back surface 26 may allow the back plate 18 to more properly fit the anatomy of the user and/or may allow it to sit comfortably against the pelvis of the user, in some examples.

The body plate 18 may have any size and/or shape that allows it to be positioned against the pelvis of the user. For example, the body plate may have an irregular triangular shape, as is illustrated in FIGS. 1A-2D. The body plate 18 may be made of any material for intimate items. For example, the body plate 18 may be made of metal, glass, plastic (e.g., polycarbonate, Acrylonitrile Butadiene Styrene (ABS)), synthetic rubber, silicone, any other body-safe material, or any combination of the preceding. In some examples, the body plate 18 is made of a smooth material and/or nonporous material, such as ABS.

The body plate 18 may include one or more harness holes 30 that extend through all or a portion of the thickness (i.e., in-between the front surface 22 and the back surface 26) of the body plate 18. The harness holes 30 may allow a harness (e.g., harness 50) to be attached to the body plate 18. For example, a strap of the harness 50 may be inserted through a harness hole 30 so as to attach the harness 50 to the body plate 18. Then the harness may be used to secure the suction docking system 14 to the user, as is illustrated in FIGS. 1A-1B. A harness hole 30 may extend entirely through the thickness of the body plate 18 (as is illustrated), or may only extend through only a portion of the thickness (e.g., to form an archway that may be used to attach a strap of the harness). The body plate 18 may include any number of harness holes 30, such as one harness hole 30, two harness holes 30, three harness holes 30, four harness holes 30, six harness holes 30, or any other number of harness holes 30. The harness holes 30 may be positioned on any location of the body plate 18. In the example illustrated in FIGS. 1A-2D, the body plate 18 includes four harness holes 30*a*-30*d*, with each harness hole 30 being positioned in (or near) a curved point of the irregular triangular shape, so as to be at the four corners of the body plate 18. In some examples, the body plate 18 may not include any harness holes 30.

In the illustrated example, the suction docking system 14 further includes a suction docking protrusion 34 that allows a prosthetic phallic device 54 to be attached to the suction docking system 14. The suction docking protrusion 34 may extend outward from the front surface 22 (or any other portion of the) body plate 18, as is illustrated. The suction docking protrusion 34 may extend outward from the front surface 22 (or any other portion of the) body plate 18 by any distance. For example, it may extend outward from the front surface 22 (or any other portion of the) body plate 18 by 0.1 inches, 0.25 inches, 0.5 inches, 1 inch, 2 inches, any other distance, or any range in-between 0.1 inches-2 inches.

In the illustrated example, the suction docking protrusion 34 includes a suction docking surface 38. The suction docking surface 38 may be any surface that operates as an attachment area for the suction cup 66 included on the prosthetic phallic device 54, via an air vacuum formed in-between the suction docking surface 38 and the suction cup 66 included on the prosthetic phallic device 54. As a result of the suction docking surface 38 operating as an attachment area for the suction cup 66 included on the prosthetic phallic device 54, via the air vacuum formed in-between the suction docking surface 38 and the suction cup 66, the prosthetic phallic device 54 may be securely attached to the suction docking surface 38 (and the suction docking system 14) using only the suction force created by the suction cup 66, in some examples. This may allow the suction-based attachment system 10 (and the suction docking system 14) to be devoid of any additional connectors (e.g., straps, an o-ring, or a peg system) for attaching the prosthetic phallic device 54 to the suction docking system 14 (e.g., to either the body plate 18 or the suction docking protrusion 34 of the suction docking system 14), in some examples. This may allow attachment and replacement of prosthetic phallic device(s) 54 to be simpler, as the person merely has to press the suction cup 66 against the suction docking surface 38 (so as to create an air vacuum), in some examples.

The suction docking surface 38 may be configured in any manner to operate as an attachment area for the suction cup 66 included on the prosthetic phallic device 54. For example, the suction docking surface 38 may be a smooth and/or non-porous surface. This may allow for an air vacuum to be formed in-between the suction docking surface 38 and the suction cup 66, thereby attaching the suction cup 66 to the suction docking surface 38. As another example, the suction docking surface 38 may be a concave surface that curves inward towards the front surface 22 of the body plate 18, a flat surface (i.e., a surface with no depths and/or curves), or a convex surface that curves outward away from the front surface 22 of the body plate 18, each of which may allow for the air vacuum to be formed in-between the suction docking surface 38 and the suction cup 66. In some examples, the suction docking surface 38 may be configured to operate as an attachment area for the suction cup 66 included on the prosthetic phallic device 54, via the air vacuum formed in-between the suction docking surface 38 and the suction cup 66 included on the prosthetic phallic device 54, by being a smooth, non-porous, and concave surface. This smooth, non-porous, and concave surface may allow for a strong connection via suction with the prosthetic phallic device 54 without the need for additional straps, o-rings, peg systems, and/or other connectors, in some examples.

In the example illustrated in FIGS. 1A-2D, the suction docking surface 38 is a concave surface that curves inward towards the front surface 22 of the body plate 18 (e.g., it curves inward like the interior of a circle). Such a concave surface may provide a stronger attachment between the suction cup 66 and the suction docking surface 38, in comparison to a flat surface or a convex surface, in some examples. The concave surface of the suction docking surface 38 may curve inward towards the front surface 22 by any amount (e.g., it may have any radius of curvature).

The suction docking surface 38 may have any size and/or shape that allows it to operate as an attachment area for the suction cup 66 included on the prosthetic phallic device 54. For example, the suction docking surface 38 may have a surface area that allows it to be used to attach a prosthetic phallic device of any size. As another example, the surface area of the suction docking surface 38 may be shaped as a circle, a square, a diamond, any other shape that will fit a suction cup 66 of a prosthetic phallic device 54, or any combination of the preceding.

The suction docking surface 38 may be angled with respect to the body plate 18. For example, the suction docking surface 38 may be angled at a tilt with respect to the body plate 18. An example of this tilt is illustrated in FIG. 2C as tilt angle 46. Tilt angle 46 represents the tilt of the suction docking surface 38 with respect to the body plate 18 (e.g., the tilt of the suction docking surface 38 from a horizontal plane through the body plate 18 when the body plate 18 is positioned upright, as is seen in FIG. 2C). In the illustrated example, the suction docking surface 38 is angled at an upward tilt with respect to the body plate. This upward tilt may be any tilt angle 46 that is greater than 90 degrees and less than 135 degrees, such as approximately 95 degrees (where approximately refers to +/−3 degrees), approximately 100 degrees, approximately 110 degrees, approximately 120 degrees, a range of approximately 95 degrees to approximately 110 degrees, or a range of approximately 95 degrees to approximately 100 degrees. The upward tilt of the suction docking surface 38 may provide one or more technical advantages, in some examples. For example, typical harness systems for a prosthetic phallic device (e.g., which use straps, an o-ring, or a peg system) may not hold the prosthetic phallic device properly. Unfortunately, this may cause the typical prosthetic phallic device to sag down or droop. In contrast, the upward tilt of the suction docking surface 38 may counter this "sag" or "droop", causing the prosthetic phallic device 54 to be more "erect" while attached suction docking system 14, in some examples. This may create an even more realistic experience, in some examples.

Although FIGS. 1A-2D illustrate the suction docking surface 38 as having an upward tilt, in other examples, the suction docking surface 38 may not be tilted at all (i.e., a tilt angle 46 of 90 degrees) or the suction docking surface 38 may have a downward tilt (i.e., a tilt angle 46 less than 90 degrees and greater than 45 degrees).

In the illustrated example, the suction docking protrusion 34 further includes a rim 42. The rim 42 surrounds all or a portion of the suction docking surface 38. Furthermore, the rim 42 extends outward from the suction docking surface 38, so that the rim 42 is raised with respect to the suction docking surface 38. The rim 42 may be used by a user as a visual and/or physical cue for aligning the suction cup 66 with the suction docking surface 38. Furthermore, if the suction cup 66 is not positioned entirely within the rim 42, the rim 42 may prevent the suction cup 66 from attaching to the suction docking system 14.

Similar to the suction docking surface 38, the rim 42 may be angled with respect to the body plate 18. For example, the rim 42 may be angled at a tilt with respect to the body plate 18. This tilt of the rim 42 may match the tilt of the suction docking surface 38. For example, both the rim 42 and the suction docking surface 38 may have the same upward tilt (i.e., the same tilt angle 46 greater than 90 degrees and less than 135 degrees). In other examples, the rim 42 may have a different tilt than the suction docking surface 38. For example, the suction docking surface 38 may have an upward tilt, while the rim 42 is not tilted (i.e., at 90 degrees) with respect to the body plate 18.

The suction docking protrusion 34 (including the suction docking surface 38 and the rim 42) may be made of any material for intimate items. For example, the suction docking protrusion 34 may be made of metal, glass, plastic (e.g., polycarbonate, ABS), synthetic rubber, silicone, any other body-safe material, or any combination of the preceding. In some examples, the suction docking protrusion 34 is made of a smooth material and/or nonporous material, such as ABS.

The suction docking protrusion 38 may be formed integral with the body plate 18. As an example of this, the entire suction docking system 14 (including the body plate 18 and the suction docking protrusion 38) may be formed of the same material (e.g., ABS) using a single injection mold. In other examples, the suction docking protrusion 38 may be formed separate from the body plate 18. In such examples, the suction docking protrusion 38 may be coupled to the body plate 18 (e.g., using an adhesive or connection system).

In the example illustrated in FIGS. 1A-1B, the suction-based attachment system 10 further includes a harness 50. The harness 50 may be any device or structure that can be coupled to the suction docking system 14, and that can further couple the suction docking system 14 to the user. The harness 50 may allow the suction docking system 14 and attached prosthetic phallic device 54 to be worn by a user for a hands-free experience, in some examples.

In the example illustrated in FIGS. 1A-1B, the harness 50 is a strap-based harness. This strap-based harness system includes straps (e.g., four straps) that each have a first end that is inserted through the harness hole 30 of the base plate 18, and that each further have a second end that all attach together around the back-side of the user (e.g., using a clip system). In other examples, the harness 50 may be a material-based harness. This material-based harness includes a piece of material (e.g., leather, fabric, synthetic material(s)) that the suction docking system 14 can be inserted into. This material-based harness may cover all or a portion of the base plate 18, but may not cover the suction docking protrusion 34. The material-based harness may additionally include straps that couple the harness to the user (similar to the strap-based harness). In other examples, the material-based harness may be worn (e.g., similar to underwear, shorts, or a costume) or may be attached to an item that may be worn.

In the example illustrated in FIGS. 1A-1B, the suction-based attachment system 10 further includes a prosthetic phallic device 54 having a suction cup 66. The prosthetic phallic device 54 may be any device used for sexual stimulation, and that has a suction cup. For example, the prosthetic phallic device 54 may be a vibrator with a suction cup, a dildo with a suction cup, or any other device used for sexual stimulation and that has a suction cup. In some examples, the prosthetic phallic device 54 may be a commercially available sexual stimulation device that has a built-in suction cup or that can be attached to a suction cup. This may be advantageous in that a user may not need to buy a specially made prosthetic phallic device to use with the suction-based attachment system 10, in some examples. Instead, the user may utilize one (or more) of many different widely commercially available prosthetic phallic devices that already have a built-in suction cup or that can be used with a suction cup, in some examples. Furthermore, if a user already has a favorite prosthetic phallic device that includes a suction cup, this favorite prosthetic phallic device can be used with the suction-based attachment system 10, in some examples.

In the example illustrated in FIGS. 1A-1B, the prosthetic phallic device 54 includes a first end 58 and a second end 62. The first end 58 includes the suction cup 66. The suction cup 66 may be any well-known suction cup (or suction device). For example, the suction cup 66 may be a flexible cup-shaped apparatus that is impenetrable to air and that includes a concave area that can be used to trap air inside of it. When the concave area of the suction cup 66 is pressed against a surface (e.g., suction docking surface 38), the trapped air is forced out of the concave area of the suction cup 66 so as to form an air vacuum in-between the suction cup 66 and the surface. This air vacuum (and the outside air pressure) may removably attach the suction cup 66 to the surface. To remove the suction cup 66 (and the prosthetic phallic device 54), a user may deform the suction cup 66 (e.g., sliding a finger between the suction cup 66 and the surface), causing air to flow into the suction cup 66 and breaking the air vacuum. The suction cup 66 may have any size and/or shape, and may be made of any material that can create and hold an air vacuum (e.g., it is impenetrable to air).

The second end 62 may be used for sexual stimulation. For example, the second end 62 may be shaped for contact with and/or insertion into a sexual organ (e.g., vagina, anus). The second end 62 extends outward from the first end 58, and may extend outward from the first end 58 by any distance. For example, the second end 62 may extend outward from the first end 58 by 1 inch, 2 inches, 4 inches, 6 inches, 8 inches, 10 inches, or any other amount.

Modifications, additions, or omissions may be made to the suction-based attachment system 10 without departing from the scope of the disclosure. For example, the suction-based attachment system 10 may include additional components, or may not include one or more of the components discussed above. As an example of this, the suction-based attachment system 10 may not include a suction docking protrusion 34. Instead, the suction docking surface 38 may be included on (or may be a part of) the body plate 18. As another example, the suction-based attachment system 10 may not include the rim 42. Furthermore, the size and/or shape of the suction-based attachment system 10 or any other component of the suction-based attachment system 10 may be changed without departing from the scope of the disclosure.

Figure 3:
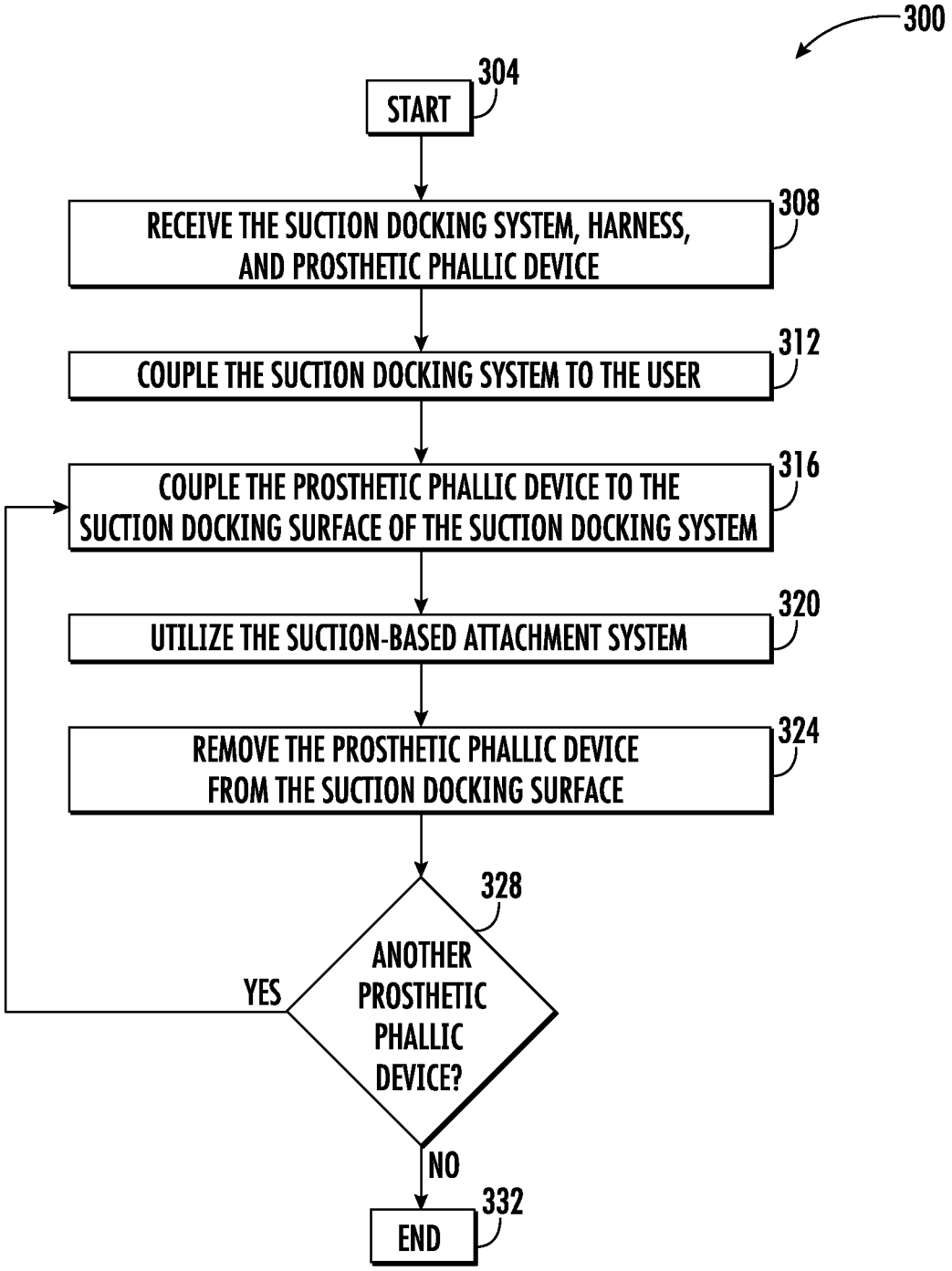
FIG. 3 illustrates one example of the operation of a suction-based attachment system.

FIG. 3 illustrates one example of the operation of a suction-based attachment system. The steps of method 300 are described as being performed using the suction-based attachment system 10 of FIGS. 1A-2D. However, one or more of the steps (such as all of the steps) of method 300 may be performed using any other suction-based attachment system, in some examples. Furthermore, one or more of the steps (such as all of the steps) of method 300 may be performed by a manufacturer of a suction-based attachment system 10, a seller of a suction-based attachment system 10, a re-seller of a suction-based attachment system 10, and/or a user of a suction-based attachment system 10.

The method 300 begins at step 304. At step 308, the suction docking system 14, the harness 50, and the prosthetic phallic device 54 are received. The suction docking system 14, the harness 50, and the prosthetic phallic device 54 may be received in any manner. For example, the suction docking system 14, the harness 50, and the prosthetic phallic device 54 may be received as a result of them being purchased, delivered, retrieved from storage, received in any manner, or any combination of the preceding. Each of the suction docking system 14, the harness 50, and the prosthetic phallic device 54 may be received in the same manner (e.g., each may be purchased) or one or more of the suction docking system 14, the harness 50, and the prosthetic phallic device 54 may be received in a different manner than the other(s) (e.g., the suction docking system 14 and the harness 50 may be purchased, and the prosthetic phallic device 54 may be retrieved from storage).

At step 312, the suction docking system 14 is coupled to the user (e.g., a person). This coupling may cause the body plate 18 of the suction docking system 14 to be positioned against a pelvis of the user, as is illustrated in FIGS. 1A-1B. It may further allow the suction docking system 14 to be worn by the user (e.g., worn against the pelvis of the user, as is seen in FIGS. 1A-1B), allowing the suction-based attachment system 10 to be used hands-free, in some examples. The suction docking system 14 may be coupled to the user in any manner. For example, the harness 50 may be attached to the suction docking system 14 (e.g., attached to the body plate 18 via harness holes 30), and then the harness 50 may be used to secure the suction docking system 14 to the user, as is also seen in FIGS. 1A-1B. In other examples, the harness 50 may already be attached to the suction docking system 14, and coupling may only include using the harness 50 to secure the suction docking system 14 to the user. As an example of this, the suction docking system 14 may be purchased with the harness 50 already attached to the suction docking system 14 (or the suction docking system 14 may already be integrated into the harness 50).

At step 316, the suction cup 66 of the prosthetic phallic device 54 is pressed against the suction docking surface 38 so as to attach the prosthetic phallic device 54 to the suction docking surface 38 (and the suction docking system 14). The pressing of the suction cup 66 may force trapped area out of the suction cup 66, so as to form an air vacuum in-between the suction cup 66 and the suction docking surface 38. This air vacuum (and thus the air pressure outside of the prosthetic phallic device 54) may removably attach the prosthetic phallic device 54 to the suction docking surface 38 (e.g., it may temporarily hold the prosthetic phallic device 54 on the suction docking surface 38). This may allow the prosthetic phallic device 54 to be easily attached to the suction docking surface 38 (e.g., without using additional connectors, such as straps, an o-ring, or a peg system), in some examples. For example, attaching the prosthetic phallic device 54 to the suction docking surface 38 is as simple and easy as aligning the suction cup 66 within the rim 42 of suction docking protrusion 34, and then applying pressure so that the air between the suction cup 66 and suction docking surface 38 is removed and proper suction is achieved, in some examples.

At step 320, the suction-based attachment system 10 is utilized. The suction-based attachment system 10 may be utilized in any manner. For example, the prosthetic phallic device 54 of the suction-based attachment system 10 may be used for sexual stimulation.

At step 324, the prosthetic phallic device 54 is removed from the suction docking surface 38. The prosthetic phallic device 54 may be removed from the suction docking surface 38 in any manner. For example, the user may deform the suction cup 66 (e.g., sliding a finger between the suction cup 66 and the suction docking surface 38), causing air to flow into the suction cup 66 and breaking the air vacuum. This allows the prosthetic phallic device 54 to be easily removed from the suction docking surface 38 (e.g., without undoing additional connectors, such as straps, an o-ring, or a peg system), in some examples.

At step 328, the user decides whether to use another prosthetic phallic device 54. If the user decides to not use another prosthetic phallic device 54, the method 300 moves to step 332 where the method ends. On the other hand, if the user decides to use another prosthetic phallic device 54 (such as a second prosthetic phallic device 54 that has a different size and/or shape than the first), the method moves back to step 316, where the suction cup 66 of the second prosthetic phallic device 54 is pressed against the suction docking surface 38 so as to attach the second prosthetic phallic device 54 to the suction docking surface 38 (and the suction docking system 14). Then steps 316-328 are repeated. Steps 316-328 may be repeated for any number of prosthetic phallic device 54.

Modifications, additions, or omissions may be made to method 300. For example, one or more of the steps of method 300 may be performed in parallel, or in a different order.

This specification has been written with reference to various non-limiting and non-exhaustive examples. However, it will be recognized by persons having ordinary skill in the art that various substitutions, modifications, or combinations of any of the disclosed examples (or portions thereof) may be made within the scope of this specification. Thus, it is contemplated and understood that this specification supports additional examples not expressly set forth in this specification. Such examples may be obtained, for example, by combining, modifying, or reorganizing any of the disclosed components, elements, features, aspects, characteristics, limitations, and the like, of the various non-limiting and non-exhaustive examples described in this specification.

The invention claimed is:

1. A suction-based attachment system, comprising:

a suction docking system comprising:

a body plate configured to be positioned against a pelvis of a person, the body plate having a concave back surface configured to face the pelvis of the person, the body plate further having a front surface configured to face away from the pelvis of the person; and a suction docking protrusion extending outward from the front surface of the body plate, the suction docking protrusion having a suction docking surface and a rim that surrounds the suction docking surface, the suction docking surface being configured to operate as an attachment area for a suction cup included on a prosthetic phallic device, via an air vacuum formed in-between the suction docking surface and the suction cup included on the prosthetic phallic device, the suction docking surface being a concave surface, the suction docking surface and the rim being angled at a fixed upward tilt with respect to the body plate, the rim being raised with respect to the suction docking surface;

a harness configured to be coupled to the body plate, and further configured to couple the suction docking system to the user; and the prosthetic phallic device having a first end and a second end, the first end having the suction cup configured to removably attach to the suction docking surface of the suction docking protrusion via the air vacuum formed in-between the suction docking surface and the suction cup included on the prosthetic phallic device, the second end extending outward from the first end and being configured for sexual stimulation.

2. The suction-based attachment system of claim 1, wherein the suction-based attachment system is devoid of any additional connector for attaching the prosthetic phallic device to either the body plate or the suction docking protrusion.

3. A suction-based attachment system, comprising:

a body plate configured to be positioned against a pelvis of a person, the body plate having a back surface configured to face the pelvis of the person, the body plate further having a front surface configured to face away from the pelvis of the person;

a suction docking protrusion coupled to the body plate, the suction docking protrusion having a suction docking surface, the suction docking surface being configured to operate as an attachment area for a suction cup included on a prosthetic phallic device, via an air vacuum formed in-between the suction docking surface and the suction cup included on the prosthetic phallic device, wherein the suction docking surface is angled at a fixed upward tilt with respect to the body plate;

a harness configured to be coupled to the body plate, and further configured to couple the body plate to the person; and the prosthetic phallic device having a first end and a second end, the first end having the suction cup configured to removably attach to the suction docking surface of the suction docking protrusion via the air vacuum formed in-between the suction docking surface and the suction cup included on the prosthetic phallic device, the second end extending outward from the first end and being configured for sexual stimulation.

4. The suction-based attachment system of claim 3, wherein the suction-based attachment system is devoid of any additional connector for attaching the prosthetic phallic device to either the body plate or the suction docking protrusion.

5. The suction-based attachment system of claim 3, wherein the suction docking surface is a concave surface.

6. The suction-based attachment system of claim 3, wherein the suction docking surface is a flat surface.

7. The suction-based attachment system of claim 3, wherein the suction docking surface is a convex surface.

8. The suction-based attachment system of claim 3, wherein the suction docking protrusion is integrally formed with the body plate, and wherein the suction docking protrusion extends outward from the front surface of the body plate.

9. The suction-based attachment system of claim 3, wherein the suction docking protrusion further has a rim surrounding all or a portion of the suction docking surface.

10. The suction-based attachment system of claim 3, wherein the back surface of the body plate is a concave surface.

11. The suction-based attachment system of claim 3, wherein the suction docking surface is a non-porous surface.

12. A method, comprising:

coupling a suction docking system to a user so that a body plate of the suction docking system is positioned against a pelvis of the user; and pressing a suction cup of a prosthetic phallic device against a suction docking surface of the suction docking system so as to create an air vacuum in-between the suction cup and the suction docking surface that holds the prosthetic phallic device on the suction docking surface, the suction docking surface having a fixed upward tilt with respect to the body plate of the suction docking system.

13. The method of claim 12, further comprising:

removing the suction cup of the prosthetic phallic device from the suction docking surface of the suction docking system; and pressing a second suction cup of a second prosthetic phallic device against the suction docking surface of the suction docking system so as to create a second air vacuum in-between the second suction cup and the suction docking surface that holds the second prosthetic phallic device on the suction docking surface.

14. The method of claim 12, wherein the suction docking system is devoid of any additional connector for attaching the prosthetic phallic device to either the body plate or the suction docking surface.

* * * * *